United States Patent [19]

Ballmann et al.

[11] 4,304,567

[45] Dec. 8, 1981

[54] PROCESS FOR THE PAD-DYEING OF TEXTILE WEBS OF CELLULOSE FIBERS

[75] Inventors: Hans J. Ballmann; Hans-Ulrich von der Eltz, both of Frankfurt am Main, Fed. Rep. of Germany

[73] Assignee: Hoechst Aktiengesellschaft, Frankfurt am Main, Fed. Rep. of Germany

[21] Appl. No.: 147,595

[22] Filed: May 7, 1980

[30] Foreign Application Priority Data

May 9, 1979 [DE] Fed. Rep. of Germany ..... 2918607

[51] Int. Cl.[3] ..... C09B 62/00; D06P 3/66

[52] U.S. Cl. ..... 8/543; 8/555; 8/918

[58] Field of Search ..... 8/555, 543, 918; 526/303, 304

[56] References Cited

U.S. PATENT DOCUMENTS 3,198,595 8/1965 Mawsen et al. ..... 8/555
3,957,427 5/1976 Chambers ..... 8/555
4,242,090 12/1980 von der Eltz ..... 8/532

FOREIGN PATENT DOCUMENTS 2738494 5/1978 Fed. Rep. of Germany ..... 8/555
45-7711 3/1970 Japan ..... 8/555
1523408 8/1978 United Kingdom .
2017763 10/1979 United Kingdom .

*Primary Examiner*—A. Lionel Clingman
*Attorney, Agent, or Firm*—Curtis, Morris & Safford

[57] ABSTRACT

A process for the pad-dyeing of textile webs, especially tubular knitted fabrics, which consist totally or partially of cellulose fibers, wherein the textile material is padded on a padder with an aqueous liquor of reactive dyestuffs, alkalis for their fixation and wetting agents, said liquor additionally containing polymers or copolymers of acrylic acid amide in aqueous solution, in order to avoid difficulties with regard to an even dye penetration and uniform squeezed edges, and the dyestuffs are fixed according to the cold-dwell dyeing process.

9 Claims, No Drawings

PROCESS FOR THE PAD-DYEING OF TEXTILE WEBS OF CELLULOSE FIBERS

The present invention relates to a process for the pad-dyeing of textile webs containing or consisting of cellulose fibers, preferably tubular knitted fabrics, with reactive dyestuffs according to a cold-dwell dyeing process.

The semicontinuous cold-dwell dyeing process for padding operations on piece goods of cellulose fibers with reactive dyestuffs is generally known and has been very well established in practice. And, the cold-dwell pad-dyeing process for tubular knitted goods of cellulose fibers with reactive dyestuffs is already known per se, for example from Textilbetrieb, 7–8, 1976, pages 43 to 45. However, in the attempt to extend the favorable experience with woven goods to tubular knitted goods, difficulties with regard to evenness have arisen again and again, especially with loom-state untreated goods, despite the fact that very good special constructions have meanwhile been designed for padders and stretchers for tubular goods.

When passing through the squeezing device of the padder, the tubular knitted goods are placed double, so that as a consequence the squeezed edges obtain less liquor than the other material in the double layer. If this deficiency is not compensated effectively, the squeezed edges are clearly marked as longitudinal stripes of a lighter shade. The penetration of the dye through the double layer (and the individual filaments) is impaired, too, which results in a dyeing of the inner side of the tube which is lighter and less even than that of the outer surface. The entire appearance of the goods is often unsettled. Articles of this kind are unmarketable, which has led to recommendations to use devices which make it possible to shift the edges or to blow in air. However, these approaches have not been successful in every case.

It has now been found that textile webs containing or consisting of cellulose fibers, preferably tubular knitted goods, can be pad-dyed while avoiding the abovementioned difficulties with regard to evenness and dye penetration, acording to a cold-dwell dyeing process at temperatures of from about 5° C. to about 40° C., with an aqueous liquor containing reactive dyestuffs, alkali for fixing and wetting agents wherein also incorporated in the liquor are polymers or copolymers of an acrylic acid amide in an amount of from 0.4 to 5 g/l in the form of aqueous solutions.

Suitable polymers or copolymers of acrylic acid amides are, for example:

a. linear or branched polymers of acrylic acid amide;

b. copolymers of acrylic acid amide and semiesters of maleic acid with polyglycol ethers of natural or synthetic fatty alcohols of from 12 to 18 carbon atoms with 5 to 10 mols of ethylene oxide per mol of fatty alcohol, in the weight ratio of from 1:0.05 to 1:0.5, calculated on the acrylic acid amide;

copolymers of acrylic acid amide and acrylamido-lower alkane-sulfonic acid in the weight ratio of from 1:0.05 to 1:05, calculated on the acrylic acid amide;

d. copolymers of acrylic acid amide and N-vinyl-N-methylacetamide in the weight ratio of from 1:0.05 to 1:0.5, calculated on the acrylic acid amide;

e. mixtures of the polymers specified under (a) to (d) above among one another and optionally in combination with ϵ-caprolactam in the weight ratio of from 1:0.5 to 1:1, calculated on the polymers.

Surprisingly, the specific properties of the abovementioned acrylic acid amide polymers lead to an increased liquor pick-up with the same roll pressure (in bars/cm$^2$). This effect is about proportional to the applied amount of the polymer products, i.e. the higher the concentration applied, the stronger is the increase of liquor pick-up within a range that is technically justifiable (concentrations of 0.4 to 5 g/l of the polymers being added as aqueous solutions).

However, comparisons with solutions of common thickeners have shown that the unexpected phenomenon of increased liquor pick-up is independent of the viscosity of the liquor.

Under the influence of the acrylic acid amide polymers applied, the padded liquors show a favorable behavior during the dwelling process on the material, which was also surprising for those skilled in the art. Although the liquor pick-up has been increased, the liquor on the wound-up goods (skein) shows a strongly reduced tendency to "sagging" (accumulation of liquor in the lower part of the goods under the influence of gravity) during dwelling without rotation or during cuttling-up, compared with the effect obtained if an increase of the liquor pick-up to values of more than 120% was to be achieved without said products by reducing the roll pressure of the padder.

The increased liquor pick-up has in its turn two surprising effects. First of all, as has already been pointed out, it involves a compensation for the irregularities shown by the textile material immediately after leaving the padder, by way of diffusion, i.e. during dwelling there is a migration of the liquor with the dyestuff to those placed which show a liquor deficiency due to squeezing. The second effect resides in a greater color depth, in proportion to the increase of liquor pick-up.

The proportional dependence of the color depth on the liquor pick-up with a given dyestuff concentration has been proved by colorimetry.

Of the textile materials, all web-like textiles are suitable for the process of the invention which contain or consist of cellulose, i.e. woven or knitted goods, but preferably tubular knitted fabrics for which the uniformity of dyeing is particularly important. In the case of knitted fabrics, even loom-state goods (especially advantageous with very full or covered shades) may be used, yet for all sized materials a desizing cannot be avoided. In the case of flat or closely woven fabrics and fiber mixtures, the effect is less pronounced, thus requiring slightly higher concentrations of the polymers applied.

For the dyeing of cellulose fibers or the cellulose fiber portion of fiber mixtures of textile webs according to the present process, suitable reactive dyestuffs are the organic dyestuffs known by this term, regardless of the type of their reactive group. This dyestuff class is termed "Reactive Dyes" in Colour Index, 3rd edition 1971. Such dyestuffs are predominantly those which contain at least one group capable of reacting with polyhydroxyl fibers, a precursor of said group, or a substituent capable of reacting with the polyhydroxyl fiber. As basic structures of the organic dyestuffs there are particularly suitable those from the series of azo, anthraquinone and phthalocyanine dyestuffs, the azo and phthalocyanine dyestuffs either being free from metal or containing metal. Suitable reactive groups and precursors which form the reactive groups are, for example, epoxy groups, the ethylene imine group, the vinyl grouping in the vinyl sulfone or acrylic acid radical, and furthermore the β-sulfatoethylsulfone group, the β-chloroethyl sulfone group, the β-phosphatoethyl sulfone group, or the β-dialkylaminoethyl sulfone group. Also suitable for use in the process are derivatives of the tetrafluorocyclobutyl series, for example of tetrafluorocyclobutylacrylic acid. Suitable reactive substituents in reactive dyestuffs are those which can easily be split off, while leaving an electrophilic radical. As substituents there may be cited for example 1 to 3 halogen atoms in the following ring systems; quinoxaline, triazine, pyrimidine, phthalazine, pyridazine, and pyridazone. Use may also be made of dyestuffs having several homogeneous or heterogeneous reactive groups.

Of the polymer products applied in accordance with the invention, some are already known (German Offenlegungsschrift No. 2,542,051, Cassella Aktiengesellschaft), however, they are used for a completely different purpose, namely to suppress the "frosting effect" in the dyeing of polyester fibers with disperse dyestuffs.

All application principles for the cold-dwell dyeing process with reactive dyestuffs on cellulose fibers, such as the dyestuff selection, the padding liquor temperature, the type and amount of alkali, and the dwelling period, remain unchanged, like the aftertreatment operations. The fastness properties which may be obtained according to the process of the invention correspond to those obtainable with the same color depth on cellulose according to other conventional batchwise exhaustion or padding processes.

The padding liquors are prepared by dissolving the dyestuff, the wetting agent and the selected polymeric acrylic acid amide product by heating-at first without alkali, then during introduction of the selected alkali in doses into the trough by means of a dosing device-and the tubular knitted fabric of cellulose is padded on a padder at 5° to 40° C., and thereafter wound up or taken off with edge on edge and covered with foil. As alkali, a mixture of sodium silicate and sodium hydroxide solution has proved to be very appropriate (cf. the known water-glass process according to German Pat. Nos. 1,619,510 and 1,619,513), as this prevents the open edges of the material on the skein from getting a lighter shade. After the corresponding cold-dwell period, which depends on the respective dyestuff, the material is aftertreated in common manner by thorough rinsing and neutral soaping.

The following Examples illustrate the invention.

EXAMPLE 1

A loom-state tubular knitted fabric of cotton is padded at room temperature on a special padder for knitted fabrics with a roll pressure of 1 bar/cm$^2$ with a liquor containing per liter 45 g of the reactive dyestuff Reactive Black 5 (Colour Index No. 20 505), 15 g of the reactive dyestuff of the formula

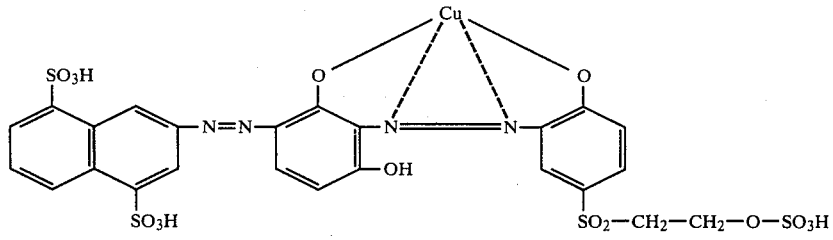

8 g of a commercial anionic wetting agent and 30 g of linear polyacrylic acid amide (padding auxiliary) in the form of its 4.3% by weight aqueous solution (molecular weight $1.4\times10^6$).

The alkali required for fixing is introduced in doses into the trough by means of a dosing pump, in an amount of 90 cm$^3$ of a (commercial) sodium water-glass solution with a specific weight of 1.345 (=37°Bé), in which the ratio of $Na_2O:SiO_2$ is 1:3.3, and 30 cm$^3$ of sodium hydroxide solution of 32.5% by weight per liter of padding liquor. The liquor pick-up obtained in this process is 183%.

After the padded goods have been wound up with edge on edge and covered, the are allowed to dwell over night with slow rotation. The aftertreatment is carried out in common manner by thorough rinsing and hot neutral soaping with a non-ionic detergent (0.5 g/l of the addition product of 8 mols of ethylene oxide to 1 mol of nonyl phenol) for 20 minutes at 90° C.

There is obtained an unusually full black dyeing on the knitted cotton fabric which is even in all respects.

If operations are the same as above, however, with the omission of the acrylamide polymer product, the liquor pickup obtained is only 103% with the same squeezing pressure of the rolls, the resulting color depth being markedly lower. Colorimetric tests showed tha the greater color depth of the first dyeing with acrylic acid amide polymer corresponds to the higher liquor pick up. The fastness properties are the same, however. The fastness to rubbing of the fuller dyeing is in no way lower than that of the second dyeing.

EXAMPLE 2

Untreated knitted cotton fabric (interlock) is padded at 22° C. on a special padder for knitted goods with a roll pressure of 1 bar/cm$^2$ with an aqueous liquor containing per liter 21 g of the reactive dyestuff Reactive Orange 16 (Colour Index No. 17 757), 40 g of the reactive dyestuff of the formula

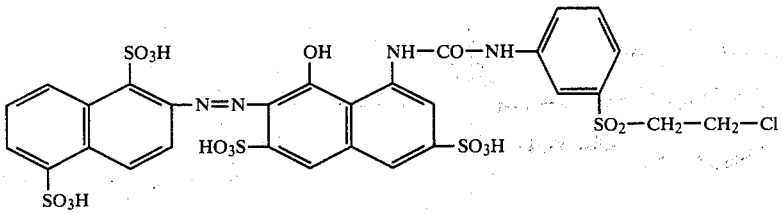

8 g of a commercial anionic wetting agent and 30 g of the copolymer (padding auxiliary) of acrylic acid amide and the semiester of maleic acid with the polyglycol ether of the addition product of 8 mols of ethylene oxide to 1 mol of isotridecyl alcohol in the weight ratio of 1:0.075 (calculated on the acrylic acid amide) in the form of its 4.3% aqueous solution (molecular weight of the above-mentioned copolymer $1.47\times10^6$).

The alkali required is introduced in doses by means of a dosing pump in an amount of 130 $cm^3$ of a (commercial) sodium water-glass solution with a specific weight of 1.345 (37°Be), in which the ratio of $Na_2O:SiO_2$ is 1:3.3, and 34 $cm^3$ of 32.5% by weight sodium hydroxide solution per liter of padding liquor. The resulting liquor pick-up is 171%.

After the padded goods have been wound up with low tension edge on edge and covered with foil, they are allowed to dwell for 15 hours with slow rotation. The aftertreatment is carried out as has been described in Example 1.

There is obtained a completely even full red dyeing.

If the dyeing is carried out as has been described above, however, while omitting the acrylic acid amide copolymer, a liquor pick-up of only 104% results after the padding and sqeezing with the same squeezing pressure. The dyeing obtained in this process is uneven (marked edges) differs from that resulting from the addition of the acrylic acid amide copolymer in its color depth by a value proportional to that by which the liquor pick-up with the former process differs from same with the latter process.

EXAMPLE 3

With a squeezing pressure of 1 bar/$cm^2$, bleached terry cloth of cotton is padded at a temperature of 24° C., on a padder with an aqueous liquor containing per liter 22 g of the reactive dye of the formula

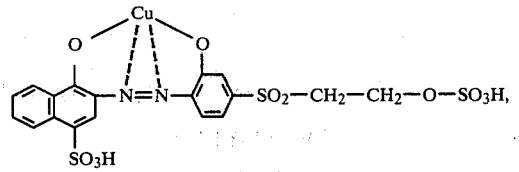

25 g of the reactive dye of the formula

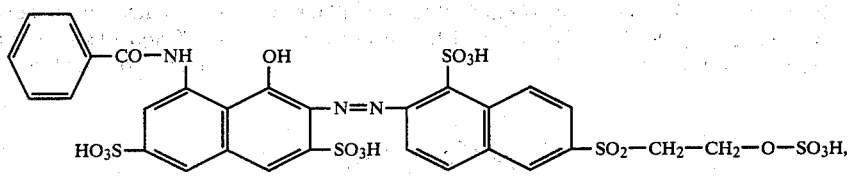

15 g of the reactive dye of the formula

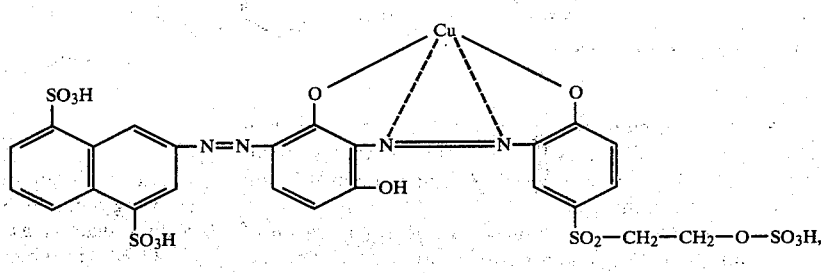

8 g of a commercial anionic wetting agent and 30 g of the copolymer (padding auxiliary) of acryic acid amide and 2-acrylamido-2-methyl-propane-1-sulfonic acid in the weight ratio of 1:0.1 (calculated on the acrylic acid amide) in the form of its 4.3% aqueous solution (molecular weight of the above-mentioned copolymer $1.9\times10^6$).

The alkali required for fixing is introduced in doses into the trough by means of a dosing pump, in an amount of 120 $cm^3$ of a commercial sodium water-glass solution with a specific weight of 1.41 (42°Bé), in which the ratio of $Na_2O:SiO_2$ is 1:2.5, and 20 $cm^3$ of 32.5% by weight sodium hydroxide solution per liter of padding liquor. The liquor pick-up is 167%.

After having been cuttled up and covered, the padded goods are allowed to dwell. The aftertreatment is effected as has been described in Examples 1 and 2. There is obtained a full even bordeaux dyeing with a very good dyestuff penetration.

If the addition of the acrylamide copolymer is omitted and operations are otherwise carried out as described before, a liquor pick-up of only 98% is obtained with the same roll pressure, along with a correspondingly lighter and also uneven dyeing.

containing per liter 24 g of the reactive dyestuff of the formula

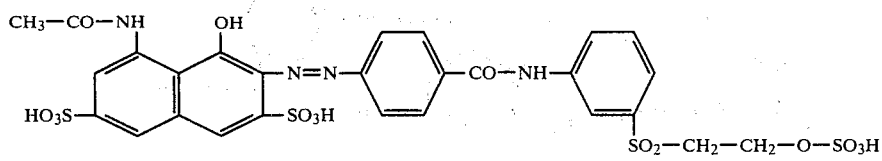

15 g of the reactive dyestuff of the formula

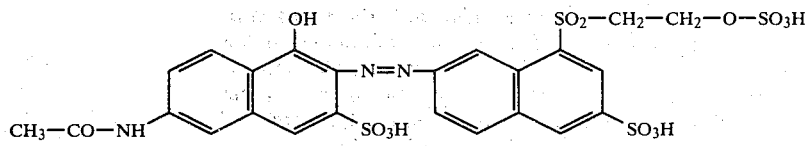

EXAMPLE 4

An untreated tubular knitted fabric of a mixed yarn of 50% of cotton and 50% of polyacrylonitrile fibers is padded on a padder with a roll squeezing pressure of 1 bar/cm$^2$ at 22° C. with an aqueous liquor containing per liter 3.8 g of the reactive dyestuff Reactive Black 5 (Colour Index No. 20 505), 15.0 g of the reactive dyestuff of the formula

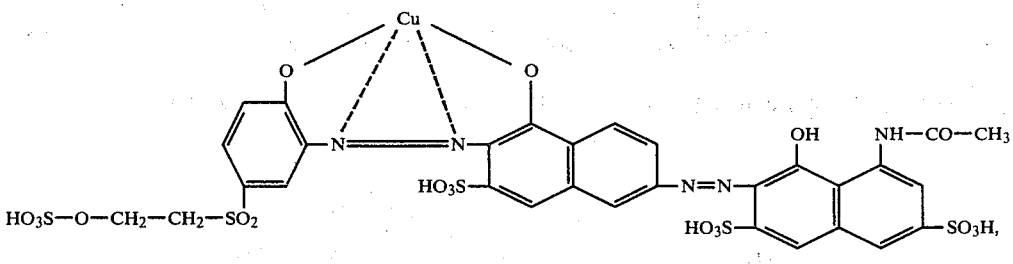

8 g of a commercial wetting agent (anionic) and 40 g of a branched polyacrylic acid amide (padding auxiliary) in the form of its 4.3% by weight aqueous solution (molecular weight $1.4\times10^6$).

The alkali required is introduced in doses by means of a dosing device in an amount of 120 cm$^3$ in a commercial sodium water-glass solution of a specific weight of 1.41 (42°Bé), in which the ratio of $Na_2O:SiO_2$ is 1:2.5, and 16 cm$^3$ of 32.5% sodium hydroxide solution per liter of padding liquor.

The resulting pick-up is 113%.

After the padded goods have been wound up with edge on edge and covered, they are allowed to dwell for 7 hours with slow rotation. The aftertreatment is carried out as has been described in Example 1.

There is obtained a full and even navy-blue dyeing on the cellulose fiber portion of the mixed fabric without any marked edges. If the addition of the above-mentioned polyacrylic acid amide is omitted and operations are otherwise carried out as described before, a liquor pick-up of only 78% is obtained with the same roll pressure, as well as a lighter dyeing which corresponds to the reduced liquor pick-up.

EXAMPLE 5

A loom-state circular knitted fabric of a mixed yarn of 50% of polyester fibers and 50% of cotton fibers is padded on a padder at 20° C. with an aqueous liquor 8 g of a commercial anionic wetting agent and 40 g of the copolymer (padding auxiliary) of acrylic acid amide and the semiester of maleic acid with the polyglycol ether of the addition product of 8 mols of ethylene oxide to 1 mol of stearyl alcohol in the weight ratio of 1:0.08 (calculated on the acrylic acid amide) in the form of its 4.3% aqueous solution (molecular weight of the above-mentioned copolymer $1.4\times10^6$).

The alkali required is introduced in doses by means of a dosing pump in an amount of 120 cm$^3$ of a commercial sodium water-glass solution of a specific weight of 1.41 (=42°Bé), in which the ratio of $Na_2O:SiO_2$ is 1:2.5, per liter of padding liquor. The resulting liquor pick-up is 128%.

After the padded goods have been cuttled up, the dyestuffs are fixed within 6 hours by dwelling at room temperature. The cotton portion has been dyed in a full and unobjectionable even red shade. The topping (cross-dyeing) of the polyester fiber portion is performed on a winch beck by a carrier dyeing with disperse dyestuffs at boiling temperature following a rinsing process.

When omitting the addition of the above-mentioned acrylic acid amide copolymer in the padding process and carrying out the other operations as described above, there is obtained a liquor pick-up of only 81%, along with a correspondingly lighter shade.

EXAMPLE 6

Loom-state cotton interlock fabric in tubular form is padded at room temperature on a padder for knitted fabrics with a roll pressure of 1 bar/cm$^2$ with a liquor containing per liter 30 g of the reactive dyestuff of the formula

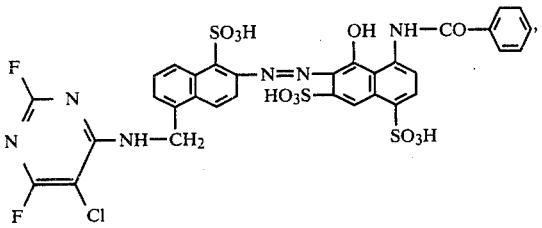

30 g of the reactive dyestuff of the formula

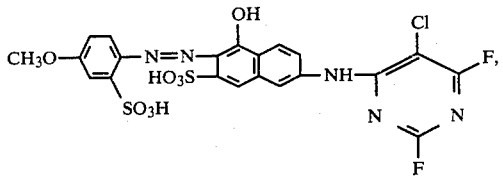

7 g of a commercial anionic wetting agent, 40 g of the padding auxiliary described in Example 5 and 80 g of urea.

The alkali required for fixing is introduced in doses into the trough by means of a dosing device, in an amount of 8 $cm^3$ of 32.5% sodium hydroxide solution and 10 g of anhydrous sodium carbonate per liter of dyeing liquor. The liquor pick-up is 171%.

The goods thus padded are cuttled up and covered; subsequently they are allowed to dwell. The aftertreatment is carried out as has been described in Example 1.

There is obtained an unusually full and completely even dyeing in a bright signal red shade.

If the dyeing is carried out under comparable conditions, yet without the above-mentioned padding auxiliary, there is obtained a liquor pick-up of only 108% with a correspondingly lower color depth and a far more unsettled appearance of the goods. Also, the penetration of the dyestuff into the inner layers of the tubular knitted fabric is not as uniform, either.

EXAMPLE 7

A tubular knitted fabric of cotton is padded at room temperature on a padder with a pressure of 1 bar/$cm^2$ with an aqueous liquor containing per liter 60 g of the reactive dyestuff of the formula

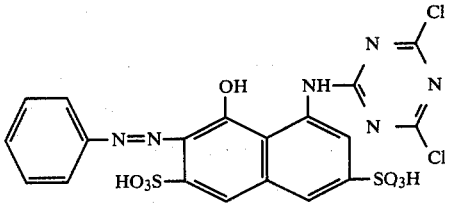

6 g of a commercial anionic wetting agent and 40 g of the padding auxiliary described in Example 1 in the form of a 4.3% aqueous solution.

The alkali required for fixing is introduced in doses into the trough by means of a dosing pump, in an amount of 30 g of anhydrous sodium carbonate per liter of padding liquor, the liquor pick-up being 173%.

The padded goods are cuttled up and covered before being allowed to dwell. The further treatment is carried out as has been described in Example 1.

A completely even and full bluish red dyeing is obtained.

When omitting the addition of the padding auxiliary, a dyeing is obtained which shows uneven spots.

In that case, the liquor pick-up is only 105% (with the same roll pressure). The color depth corresponds to the reduced liquor pick-up.

What is claimed is:

1. In a process for the pad-dyeing of a textile web containing or consisting of cellulose fibers with one or more reactive dyestuffs according to a cold-dwell dyeing process in which the textile web is padded on the padder with an aqueous liquor at room temperature, the liquor containing one or more reactive dyestuffs, alkali for fixing same and one or more wetting agents, the improvement which comprises incorporating in said liquor a polymeric component selected from the group consisting of homopolymers and copolymers of acrylic acid amide and mixtures of the foregoing, said polymeric component being incorporated in an amount of from 0.4 to 5 g/l in the form of an aqueous solution.

2. A process as claimed in claim 1, wherein said polymeric component is selected from the group consisting of linear homopolymers and branched homopolymers of acrylic acid amide.

3. A process as claimed in claim 1, wherein said polymeric component is selected from the group consisting of copolymers of acrylic acid amide and semiesters of maleic acid with polyglycol ethers of natural or synthetic fatty alcohols of from 12 to 18 carbon atoms with from 5 to 10 mols of ethylene oxide per mol of fatty alcohol, in a weight ratio of from 1:0.05 to 1:0.5, calculated on the acrylic acid amide.

4. A process as claimed in claim 1, wherein the polymeric component is selected from the group consisting of copolymers of acrylic acid amide and acrylamido-lower alkane sulfonic acid in a weight ratio of from 1:0.05 to 1:0.5, calculated on the acrylic acid amide.

5. A process as claimed in claim 1, wherein said polymeric component is selected from the group consisting of copolymers of acrylic acid amide and N-vinyl-N-methylacetamide in a weight ratio of from 1:0.05 to 1:0.5, calculated on the acrylic acid amide.

6. A process as claimed in claim 1, wherein the polymeric component is a mixture of said homopolymers, a mixture of said copolymers or a mixture of one or more of said homopolymers and one or more of said copolymers.

7. A process as claimed in claim 1, wherein to said polymeric component ε-caprolactam is added in a weight ratio of from 1:0.5 to 1:1, calculated on the weight of the polymeric component.

8. A process as claimed in claim 1, wherein the polymeric component has a molecular weight of from $1.0\times10^6$ to $2.5\times10^6$.

9. A process as claimed in claim 1, wherein the textile web is a tubular knitted fabric containing or consisting of cellulose fibers.

* * * * *